US005230432A

United States Patent [19]

Sugai

[11] Patent Number: 5,230,432

[45] Date of Patent: Jul. 27, 1993

[54] APPARATUS FOR SINGULATING PARTS

[75] Inventor: Maureen Sugai, Mesa, Ariz.

[73] Assignee: Motorola, Inc., Schaumburg, Ill.

[21] Appl. No.: 775,391

[22] Filed: Oct. 15, 1991

[51] Int. Cl.[5] ..... B07C 5/34; B07C 5/36

[52] U.S. Cl. ..... 209/552; 198/368; 209/573; 209/698; 209/707; 209/919; 324/158 F

[58] Field of Search ..... 209/555, 556, 558, 571, 209/573, 698, 919, 939, 655, 707, 552, 912, 903; 198/368; 324/158 F

[56] References Cited

U.S. PATENT DOCUMENTS

| | | | |
|---|---|---|---|
| 3,655,041 | 4/1972 | Baker et al. | 209/919 X |
| 3,810,540 | 5/1974 | Georges | 209/573 X |
| 3,980,553 | 9/1976 | Quinn | 209/919 X |
| 4,128,174 | 12/1978 | Frisbie et al. | 209/573 |
| 4,818,322 | 4/1989 | Anderson et al. | 209/573 |
| 4,818,381 | 4/1989 | Tanaka et al. | 209/573 |
| 4,976,356 | 12/1990 | Mizuno | 209/939 X |
| 5,146,101 | 8/1992 | Linker, Sr. et al. | 209/556 X |

FOREIGN PATENT DOCUMENTS

| | | | |
|---|---|---|---|
| 3634800 | 4/1988 | Fed. Rep. of Germany | 209/573 |
| 1025605 | 6/1983 | U.S.S.R. | 209/573 |

OTHER PUBLICATIONS

R. M. Filek, et al, "Testing & Sorting Apparatus", Western Electric Technical Digests No. 35, Jul. 1974, pp. 19–20.

*Primary Examiner*—Donald T. Hajec

*Attorney, Agent, or Firm*—Joe E. Barbee; Rennie W. Dover

[57] ABSTRACT

An apparatus (19) for singulating a series of packages (17). The apparatus (19) includes a vertical wheel (12), a retainer spring (10), a gravity feed track (14), a pass track (15), and a reject track (16). The vertical wheel (12) comprises a plurality of slots (22–29), and rotates in a clockwise direction to deliver the packages (17) to an electrical test fixture (18). Upon completion of testing, the vertical wheel (12) rotates in a clockwise direction and delivers the packages (17) to either the pass track (15) or the reject track (16). A motor driven eccentric (37) actuates the retainer spring (10) to unblock the appropriate slot (22–29), thereby releasing the packages (17) from the appropriate slot (22–29).

9 Claims, 3 Drawing Sheets

APPARATUS FOR SINGULATING PARTS

BACKGROUND OF THE INVENTION

This invention relates, in general, to an apparatus for singulating individual parts, and more particularly to an apparatus having a shutter assembly capable of singulating packaged integrated circuit parts.

In the semiconductor industry, packaged integrated circuits must pass a series of electrical tests, as well as visual inspections, in order to be released to the customer. Inherent in many test and inspection regimes is the separation of single units from a plurality of units, a step commonly referred to as singulation. Further, upon completion of the testing and inspection phases, units that have failed either phase must remain separated from those that pass. Those units that have failed are referred to as reject material and typically are discarded.

Semiconductor device manufacturers have employed several different types of equipment to accomplish the task of singulating units. Some of the more common means for singulating include a motor driven two wheel system, solenoid driven machinery, systems using reciprocating parts, and systems using gates and shutters. The two most important drawbacks for these types of systems are the increased cycle times introduced by these types of apparatus and the cost for maintaining these systems. In addition, machines requiring air cylinders or solenoids for singulating parts use up time without moving the parts. Sorting mechanisms using reciprocating parts that must move and return waste time on the return. Gates and shutters are slow because they must be activated by solenoids or other means.

A high-speed integrated circuit handler was disclosed by Frisbie et. al. in U.S. Pat. No. 4,128,174 which addressed the issue of cycle time when testing and sorting integrated circuit parts. This U.S. patent is hereby incorporated herein by reference. In this patent a means for separating individual parts, having a sort wheel and a test wheel, was presented. This apparatus offered several advantages including the use of an electronic, rather than a mechanical, means for controlling the speed and positioning of both the sort and test wheels. Further, neither wheel has to return to a start position after completing an operation. Unfortunately, some drawbacks occur because of space limitations such that the sort wheel was rendered infeasible. Further, alignment between the sort and test wheels must be correct, and although the apparatus decreased cycle time significantly the alignment of sort wheel to test wheel does require time.

Accordingly, it would be beneficial to have an apparatus for separating and sorting individual parts in a fast and accurate manner while simultaneously minimizing the area required by the apparatus. Moreover, it would be beneficial to have an improved apparatus with less complex means for accomplishing the functions of separating and sorting. Finally, it would be advantageous for the system to be inexpensive to purchase as well as to maintain.

SUMMARY OF THE INVENTION

Briefly stated, the present invention is an apparatus for singulating a series of individual parts. The apparatus has a shutter assembly which cooperates with a gravity fed vertical wheel to release individual parts from slots disposed around a periphery of the vertical wheel. The shutter assembly has a retainer spring actuated by a motor driven eccentric wherein the retainer spring unblocks a slot in a first position, and when in a second position the retainer spring blocks the slot that was unblocked while in the first position. Further, the parts released by the shutter assembly are collected on a track.

DETAILED DESCRIPTION OF THE DRAWINGS

Typically, manufacturers test and inspect their product prior to release to customers. During this process good parts are sorted from those that fail the manufacturers test or inspection criteria. Parts that fail are considered reject, hence are not delivered to customers.

Figure 1:
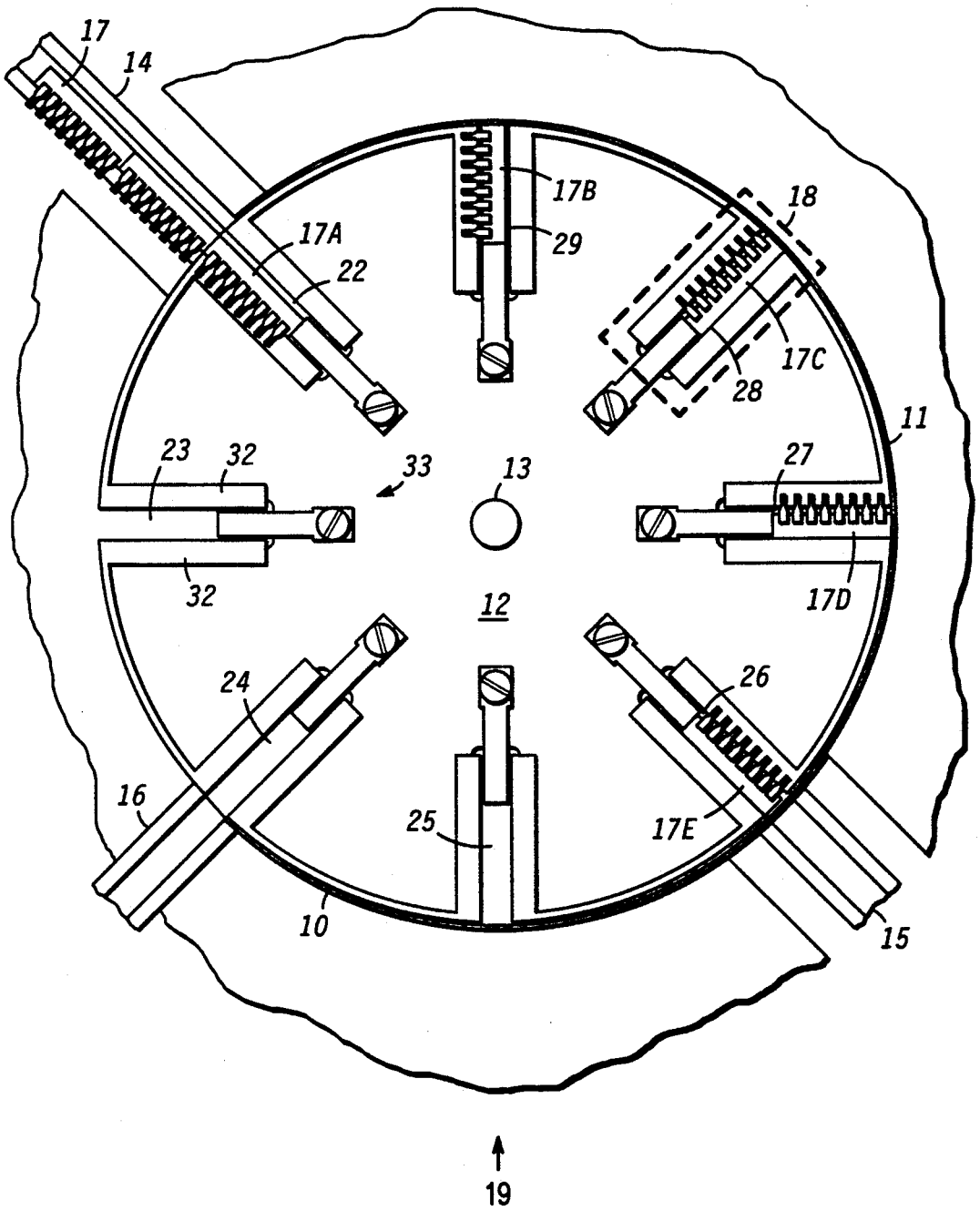
FIG. 1 is a side view of a singulating apparatus in accordance with the present invention.

FIG. 1 shows a singulating apparatus 19 having a vertical wheel 12, a retainer spring 10, a gravity feed track 14, a pass track 15, and a reject track 16. Vertical wheel 12 is a low-mass test wheel 12 mounted on a drive shaft 13. Vertical wheel 12 has eight slots or pockets 22–29 located at 45° increments around a periphery. Slots 22–29 have been referred to as pockets 22–29. Vertical wheel 12 can be, for example, about 137.5 millimeters in diameter and 2.5 millimeters in thickness. It can be made of aluminum or other lightweight metal. Additionally, the mass of vertical wheel 12 can be further reduced by cutting away unnecessary material from the interior of vertical wheel 12. Slots 22–29 in vertical wheel 12 are lined with plastic inserts 32 to provide electrical isolation between vertical wheel 12 and articles 17 which ride in slots 22–29.

Articles or packages 17 are individual parts which are preferably integrated circuit packages, wherein these packages 17 can be any of the plastic or ceramic dual-in-line packages commonly used in the semiconductor industry. Further, packages 17 can have eight or more leads depending on the integrated circuit contained therein. Moreover, different circuits may require packages of different sizes, hence adjustable stops 33 are provided in slots 22–29 so that these slots 22–29 can be adjusted to have a depth just equal to the length of the packages. The adjustable stop 33 feature allows the same handling apparatus to accommodate different parts at different times.

Gravity feed track 14 is provided at an upper portion of vertical wheel 12 for delivering packages 17 to slots 22–29. An electrical test fixture 18 cooperates with vertical wheel 12 to test packages 17. A stop spring 11 cooperates with vertical wheel 12 to block slots 27, 28, and 29, thereby preventing packages 17B, 17C, and 17D from exiting vertical wheel 12 as wheel 12 rotates. In addition, stop spring 11 serves to align packages 17 for testing by electrical test fixture 18; and in particular the testing of part 17C shown in FIG. 1.

In FIG. 1 retainer spring 10 surrounds a portion of vertical wheel 12 spanning a circumference of vertical wheel 12 starting with slot 26 to an edge of slot 24. In a first position, retainer spring 10 blocks only slot 25;

while in this first position retainer spring 10 leaves slot 26 unblocked. In a second position, retainer spring 10 blocks slots 25 and 26. Further, placing retainer spring 10 in the first position allows package 17E to exit slot 26 onto pass track 15. Placing retainer spring 10 in the second position allows packages 17 to exit onto reject track 16. Preferably retainer spring 10 is positioned in the first position as the typical position, since most packages 17 should pass both the visual and electrical criteria. In other words, slot 26 should be unblocked during most of the inspection or test period, with retainer spring 10 being moved to the second position when a package 17 must exit onto reject track 16.

Figure 2:
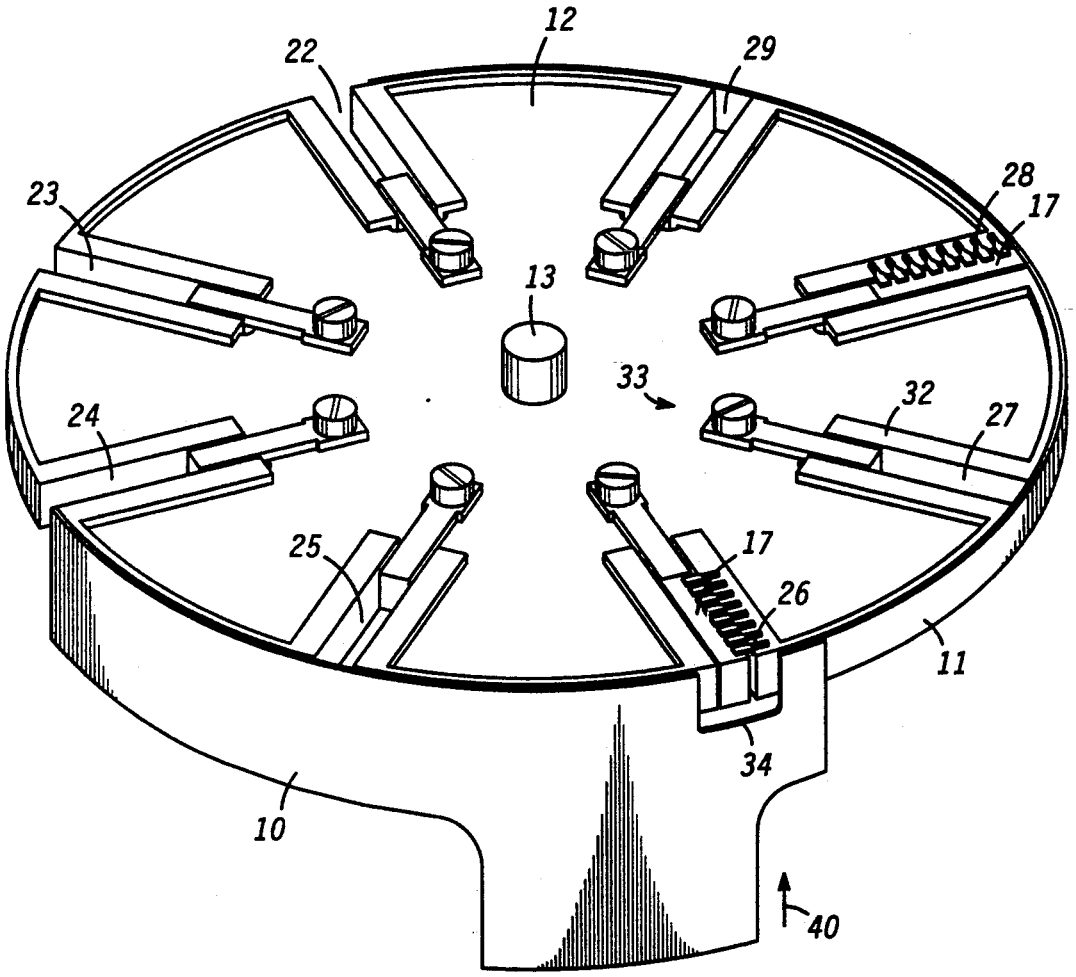
FIG. 2 is an isometric view of the vertical wheel, slots, retainer spring, and stop spring of the invention of FIG. 1.

An isometric drawing of vertical wheel 12 emphasizing retainer spring 10, stop spring 11, slots 22–29, and packages 17 is shown in FIG. 2. Retainer spring 10 overlaps stop spring 11, thereby allowing unimpeded movement of packages 17 as vertical wheel 12 rotates. Further, vertical wheel 12 rotates about a horizontal axis in a clockwise direction and in discrete partial revolutions to allow a series of packages 17 in continuous sequence to drop into slots 22–29. The horizontal axis is centered at drive shaft 13.

A notch 34 in retainer spring 10 serves to direct packages 17 to exit vertical wheel 12 at the location of slot 26 or at the location of slot 24 as shown in FIG. 2; wherein the package 17 exit location depends on the results of the inspection or tests. For example, if a package 17 passes both the visual inspection and the electrical test, retainer spring 10 is placed in a first position wherein notch 34 leaves slot 26 unblocked. If package 17 fails either the inspection or the test criteria, retainer spring 10 is moved in a direction of an arrow 40 shown in FIG. 2; thereby placing retainer spring 10 in the second position and blocking slot 26. Slot 25 remains covered whether retainer spring 10 is in either the first or the second positions. When retainer spring 10 is in the second position, package 17 exits slot 26 when slot 26 is at the position of slot 24 as shown in FIG. 2.

Preferably, retainer spring 10 and stop spring 11 are made from a resilient material such as blue spring-steel. The use of a resilient material for both retainer spring 10 and stop spring 11 decreases the probability of packages 17 becoming jammed in vertical wheel 12. Jamming occurs because of surface anomalies, such as burrs, on portions of packages 17 contacting either retainer spring 10 or stop spring 11.

Figure 3:
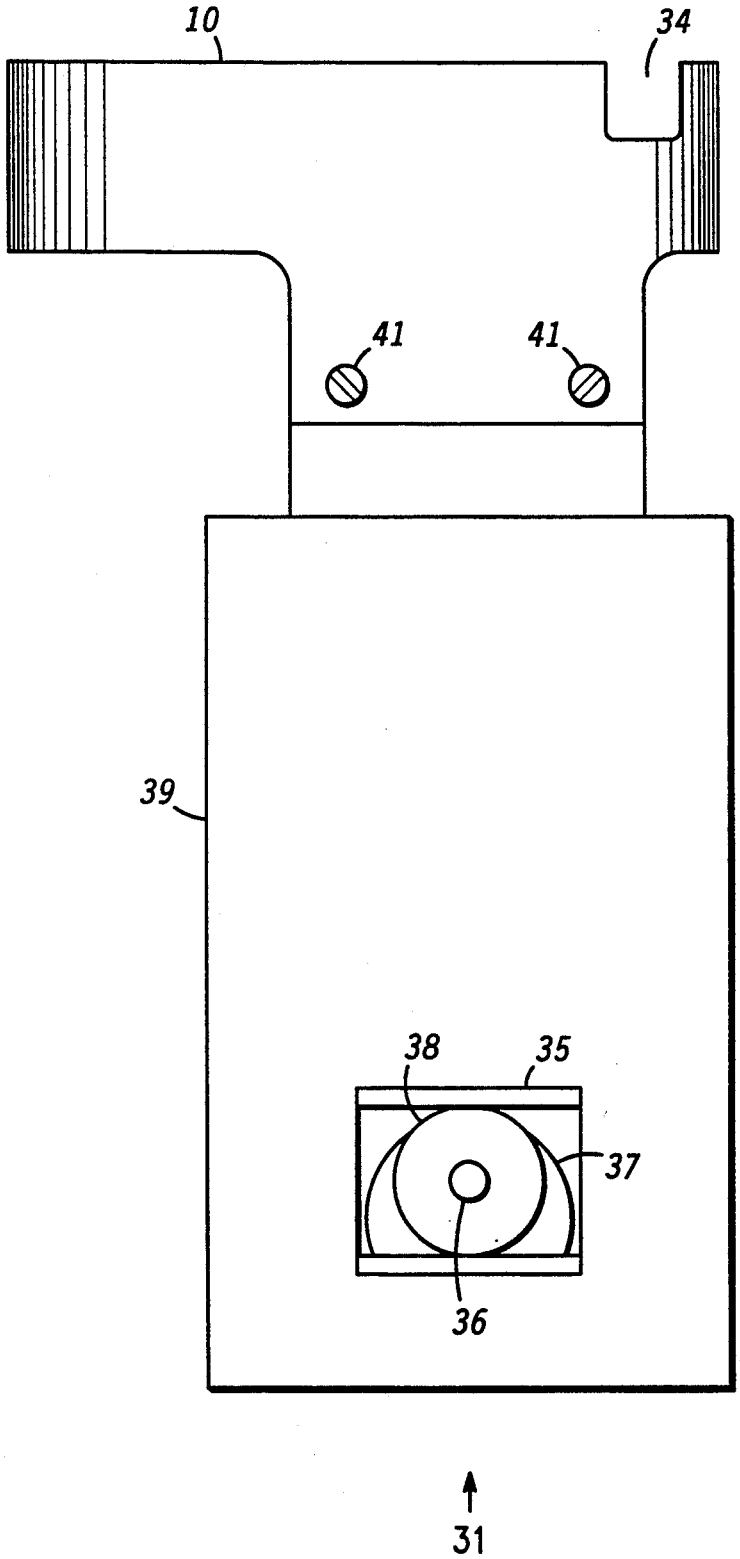
FIG. 3 is a top view of a pocket gating mechanism in accordance with the present invention.

FIG. 3 illustrates a top view of a preferred embodiment of a pocket gating mechanism 31. The embodiment of FIG. 3 shows an eccentric 37 driven by a motor (not shown). Eccentric 37 has a shaft 36 on its surface located between the center of the eccentric and a periphery of the eccentric. Further, motor driven eccentric 37 controls a bearing 38, mounted on shaft 36, which in turn modulates a slide 39. Bearing 38 has an aperture (not shown) which extends through a diameter of bearing 38, and through which shaft 36 is inserted. Moreover, bearing 38 fits inside an opening 35 in slide and pushes against the top or bottom of opening 35 thereby causing slide 39 to move up and down. It will be understood that bearing 38 fits inside opening 35 and that eccentric 37 is outside opening 35. Retainer spring 10, having notch 34, is connected to slide 39 by screws 41, hence motor driven eccentric 37 actuates retainer spring 10 via slide 39. Preferably, slide 39 is made of nylatron.

Motor driven eccentric 37 may be microprocessor (not shown) controlled, wherein eccentric 37 is driven based on the information obtained by electrical test fixture 18 shown in FIG. 1. In other words, the results of tests performed by electrical test fixture 18 are processed by the microprocessor which then instructs eccentric 37 to actuate retainer spring 10 such that an appropriate slot 22–29 is uncovered. Thus packages 17 are delivered to either pass track 15 or reject track 16 as shown in FIG. 1.

In FIG. 1, package 17A is shown to have dropped into slot 22. Because of the length of package 17A, other packages 17 on track 14 are held out of slot 22. Leads of package 17A straddle edges of slot 22 and are electrically isolated from vertical wheel 12 by plastic inserts 32. In like manner, packages 17B 17C, and 17D which previously dropped from track 14 are held in slots 29, 28, and 27 respectively. Wheel 12 is rotated through 45° in a clockwise direction. A low inertia, high torque DC motor (not shown) used with a servo drive amplifier controls the speed and position of slotted wheel 12. As vertical wheel 12 rotates, its acceleration is sufficient to force packages 17A, 17B, 17C, and 17D outward against stop spring 11. This provides alignment of package 17B with electrical test fixture 18 which cooperates with slot 29 to test package 17B. After vertical wheel 12 has rotated through 45°, slot 23 is aligned with track 14 and another package 17 crops from track 14 into slot 23. Package 17B is now in contact with electrical test fixture 18; package 17A is in an intermediate position between electrical test fixture 18 and track 14; package 17C is in an intermediate position between electrical test fixture 18 and pass track 15; package 17D is aligned with pass track 15; and another package 17 has dropped into vertical wheel 12.

After the testing of package 17B is completed, vertical wheel 12 again rotates through 45° in the clockwise direction. Moreover the test results are processed by the microprocessor which ultimately controls the positioning of retainer spring 10. While vertical wheel 12 is rotating, some of the packages 17 are kept in their respective slots 22–29 by stop spring 11. The rotation of wheel 12 through 45° moves package 17B away from test fixture 18, moves package 17A into contact with test fixture 18 for test, moves the package 17 in slot 23 to an intermediate position and allows another untested package 17 to drop from track 14 into slot 24. While the testing of package 17A occurs, retainer spring 10 is positioned by motor driven eccentric 37 based on the test results for package 17B, and wheel 12 again rotates through 45°.

Moreover, a visual inspection of packages 17 may be performed by a visual inspection system (not shown) while packages 17 are on gravity feed track 14. Similar to electrical test fixture 18, the visual inspection system may send information to the microprocessor to control the positioning of retainer spring 10. Further, the visual inspection system may also control electrical test fixture 18. As an example, when packages 17 fails the visual inspection criteria, the information may be processed such that the electrical test is not performed on package 17 by electrical test fixture 18, since that package 17 is already defective.

If, after vertical wheel 12 rotates through 45°, retainer spring 10 is in the first position, thus not covering slot 29, package 17B may drop from slot 29 onto pass track, 15. If the retainer spring 10 is in a second position, thus covering slot 29, then package 17B is released onto reject track 16. The sequence continues in this manner with packages 17 being picked from gravity feed track 14, tested, and dropped on pass track 15 if the packages 17 pass the inspection and test criteria, or onto reject track 16, otherwise.

In this particular embodiment, integrated circuit packages 17 are classified into two categories by the test and inspection procedure. The actual number of categories is selected for the particular type of package 17 being tested. In other words, the number of slots 22–29 and the number of pass tracks 15 and reject tracks 16 may be different. In order to separate packages 17 into more than two categories, retainer spring 10 is modified to have a plurality of notches 34 (not shown) wherein the notches are positioned to permit packages 17 to exit the appropriate slot 22–29 onto the appropriate pass track 15 or reject track 16. It is the function of retainer spring 10 to release tested packages 17 at the appropriate pass track 15 or reject track 16 through which the part can be moved to a reservoir of similar tested and inspected parts.

It will be understood that the configuration shown in FIG. 1 represents a single position of vertical wheel 12. Wheel 12 rotates through a full three hundred and sixty degree range, hence each slot 22–29 will be positioned at each of the locations at which slots 24, 26, and 28 are shown in FIG. 1 at various times throughout the inspection or testing procedure. Thus each slot 22–29 will interact with electrical test fixture 18, and release packages onto either pass track 15 or reject track 16. Again, the number of slots 22–29, pass tracks 15, and reject tracks 16 are not limited to the number shown in FIG. 1.

By now it should be appreciated that there has been provided an improved method for sorting individual parts from a plurality of parts. In particular, the improvements are realized by a reduction in cycle time, cost, and space required by the sorting apparatus. In addition, this apparatus has the capability of sorting parts based on electrical or visual inspection criteria.

I claim:

1. An apparatus for singulating a series of individual parts, comprising:

a gravity feed track;

a vertical wheel provided with slots disposed around a periphery of the vertical wheel, wherein the slots accept the individual parts from the gravity feed track and present the individual parts to a test fixture;

a pass track, wherein the pass track accepts the individual parts from the vertical wheel that have been tested by the test fixture and have passed the tests;

a reject track, wherein the reject track accepts the individual parts from the vertical wheel that have been tested by the test fixture and have failed the tests;

a stop spring, the stop spring extending from approximately the gravity feed track to approximately the pass track and positioned adjacent a portion of the vertical wheel with which the test fixture cooperates, wherein movement of the vertical wheel relative to the gravity feed track and stop spring determines which slots are blocked and unblocked by the stop spring; and a shutter assembly having a retainer spring actuated by a motor driven eccentric, the retainer spring surrounding a portion of the vertical wheel spanning a portion of the circumference of the vertical wheel starting at the pass track and extending to the edge of the reject track wherein the retainer spring leaves at least one slot unblocked when in a first position, and blocks the at least one slot when in a second position.

2. The apparatus for singulating of claim 1 wherein the retainer spring permits an individual part to exit from a predetermined slot.

3. The apparatus for singulating of claim 1 wherein both the stop spring and the retainer spring are made from a resilient material.

4. A method for releasing articles from slots on a test wheel, which comprises:

providing the test wheel having the slots, wherein each of the slots accepts a single article from a track, presents the article to a test fixture and transports the article away from the test fixture upon completion of tests;

providing a pass track adjacent to the test wheel at a first location;

providing a reject track adjacent to the test wheel at a second location; and actuating a retainer spring, the retainer spring extending along a portion of the circumference of the wheel from the pass track to the reject track and has a notch which cooperates with the test wheel to release the article from the slot through the notch when the retainer spring is moved to one of a first or second position, wherein the retainer spring is actuated by a motor driven eccentric to place the retainer spring in the first position, thereby releasing the article from the slot onto the pass track if the article passes the tests performed by the test fixture, and placing the retainer spring in the second position, thereby releasing the article from the slot onto the reject track if the article fails the tests performed by the test fixture.

5. The method for releasing articles from slots of claim 4 further including forming the retainer spring from a resilient material.

6. An apparatus for singulating articles, which comprises:

a gravity feed track;

a vertical wheel having a plurality of pockets on a periphery, wherein an article may drop into each pocket from the gravity feed track;

an electrical test fixture which test the article housed in each pocket;

a pass track which accepts the tested articles from the plurality of pockets when the tested articles have passed the test;

a reject track which accepts the tested articles from the plurality of pockets when the tested articles have failed the test;

a pocket gating mechanism, the pocket gating mechanism comprising a retainer spring having at least one notch which cooperates with the wheel to release the article from the pocket through the notch when the retainer spring is moved to one of a first or second position; wherein the retainer spring surrounds a portion of the vertical wheel spanning a portion of the circumference of the vertical wheel from the pass track to the reject track, and the pocket gating mechanism accepts a signal from the electrical test fixture to retainer spring in the first or second position, thereby allowing the articles to selectively exit the pocket into one of the pass or reject track.

7. The apparatus for singulating articles of claim 6 wherein the pocket gating mechanism includes a motor driven eccentric which cooperates with the retainer spring.

8. The apparatus for singulating articles of claim 6 wherein the retainer spring is constructed from a resilient material.

9. The apparatus for singulating articles of claim 6 wherein the vertical wheel rotates about a horizontal axis in a clockwise direction.

* * * * *

UNITED STATES PATENT AND TRADEMARK OFFICE

CERTIFICATE OF CORRECTION

PATENT NO. : 5,230,432

DATED : July 27, 1993

INVENTOR(S) : MAUREEN SUGAI

It is certified that error appears in the above-identified patent and that said Letters Patent is hereby corrected as shown below:

Claim 6, column 6, line 45, change "test", second occurrence, to --tests--.

Claim 6, column 6, line 63, before "retainer" insert --selectively position the--.

Signed and Sealed this

Twenty-second Day of March, 1994

*Attest:*

Bruce Lehman

BRUCE LEHMAN

*Attesting Officer*

*Commissioner of Patents and Trademarks*